US011945564B2

(12) United States Patent
Kuribayashi

(10) Patent No.: US 11,945,564 B2
(45) Date of Patent: Apr. 2, 2024

(54) STEERING DEVICE

(71) Applicant: Kay Seven Co., Ltd., Tokyo (JP)

(72) Inventor: Sadatomo Kuribayashi, Tokyo (JP)

(73) Assignee: Kay Seven Co., LTD., Tokyo (JP)

( * ) Notice: Subject to any disclaimer, the term of this patent is extended or adjusted under 35 U.S.C. 154(b) by 0 days.

(21) Appl. No.: 17/286,557

(22) PCT Filed: Jul. 22, 2020

(86) PCT No.: PCT/JP2020/028436
§ 371 (c)(1),
(2) Date: Jun. 3, 2021

(87) PCT Pub. No.: WO2021/106268
PCT Pub. Date: Jun. 3, 2021

(65) Prior Publication Data

US 2024/0010319 A1 Jan. 11, 2024

(30) Foreign Application Priority Data

Nov. 26, 2019 (JP) ..... 2019-213266

(51) Int. Cl.
*B63H 25/38* (2006.01)
*B63H 25/06* (2006.01)

(52) U.S. Cl.
CPC ..... *B63H 25/38* (2013.01); *B63H 2025/066* (2013.01)

(58) Field of Classification Search
CPC ..... B63H 25/00; B63H 25/06; B63H 25/38; B63H 25/381; B63H 25/382; B63H 2025/066; B63H 2025/387
USPC ..... 114/144 R, 162, 163, 164, 165
See application file for complete search history.

(56) References Cited

U.S. PATENT DOCUMENTS 2,251,133 A * 7/1941 Horstman ..... B63H 25/38 114/163
3,009,435 A * 11/1961 Horton, Jr. ..... B63H 25/38 114/163
3,710,749 A * 1/1973 Duryea ..... B63H 25/06 114/163
3,828,713 A * 8/1974 Duryea ..... B63H 25/06 114/163

(Continued)

FOREIGN PATENT DOCUMENTS

JP 2014-073815 4/2014
JP 2016-016777 2/2016
JP 2016-037270 3/2016

*Primary Examiner* — Daniel V Venne
(74) *Attorney, Agent, or Firm* — Lippes Mathias LLP

(57) ABSTRACT

A steering device allows a ship to travel efficiently. A port side rudder plate has a left front rudder plate fixed to a lower portion of a stern and a left rear rudder plate. A starboard side rudder plate has a right front rudder plate fixed to the lower portion of the stern and a right rear rudder plate. The left rear rudder plate is supported by a rear portion of the left front rudder plate and a left steering shaft fixed to the left rear rudder plate. The right rear rudder plate is supported by a rear portion of the right front rudder plate. A right steering shaft fixed to the right rear rudder plate. In a rear view, lower end portions of the port side rudder plate and the starboard side rudder plate are at a lower end portion of an outer peripheral portion of the propeller.

11 Claims, 8 Drawing Sheets

(56) References Cited

U.S. PATENT DOCUMENTS

| | | | | |
|---|---|---|---|---|
| 3,872,817 | A * | 3/1975 | Duryea | B63H 25/06 114/163 |
| 7,536,968 | B2 * | 5/2009 | Schreiber | B63H 25/38 114/163 |
| 9,611,009 | B1 * | 4/2017 | Myers | B63H 25/38 |
| 11,414,169 | B2 * | 8/2022 | Moerbe | B63H 25/38 |
| 11,465,723 | B1 * | 10/2022 | Choi | B63H 5/15 |

* cited by examiner

[FIG.1]
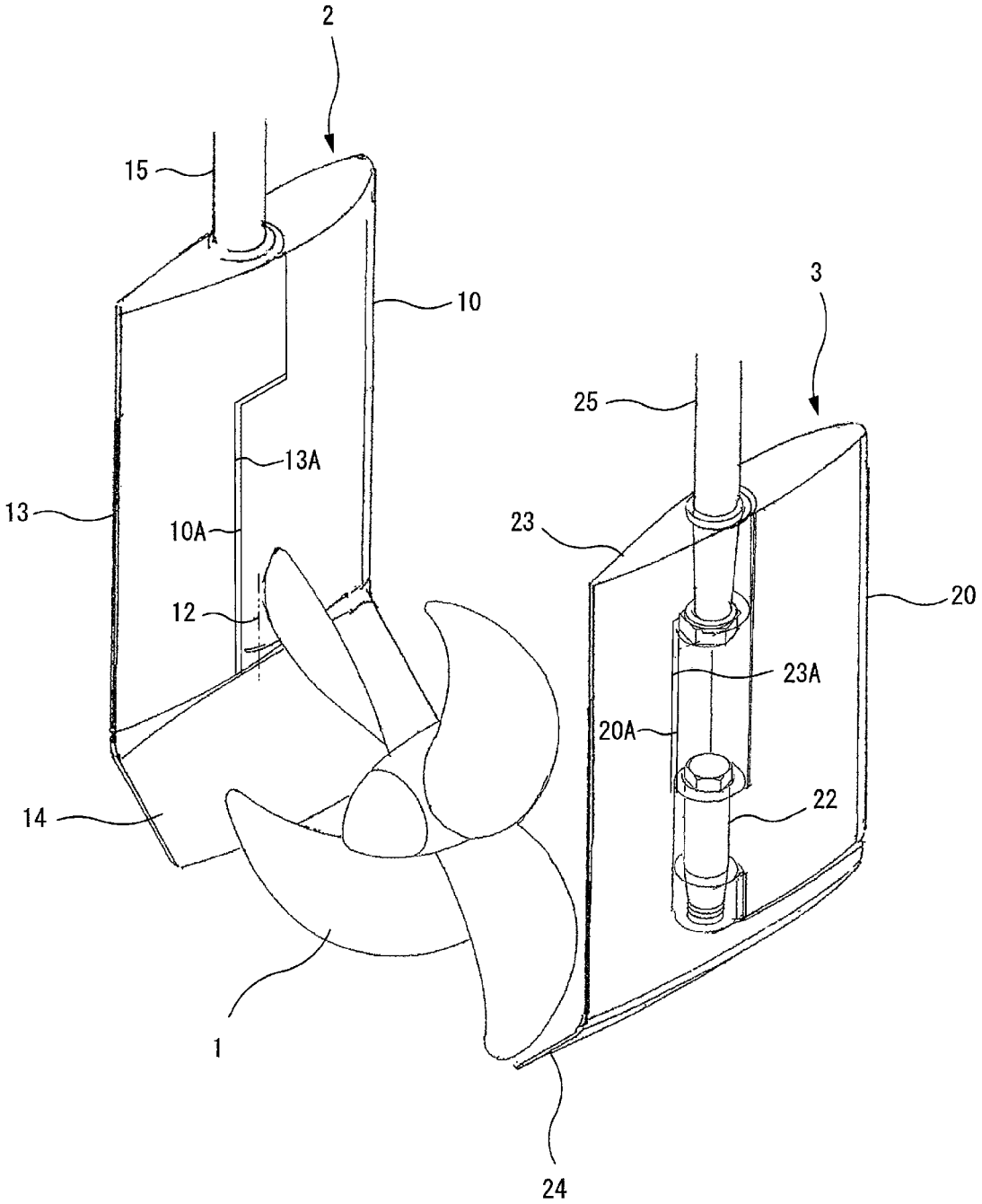

[FIG.2]
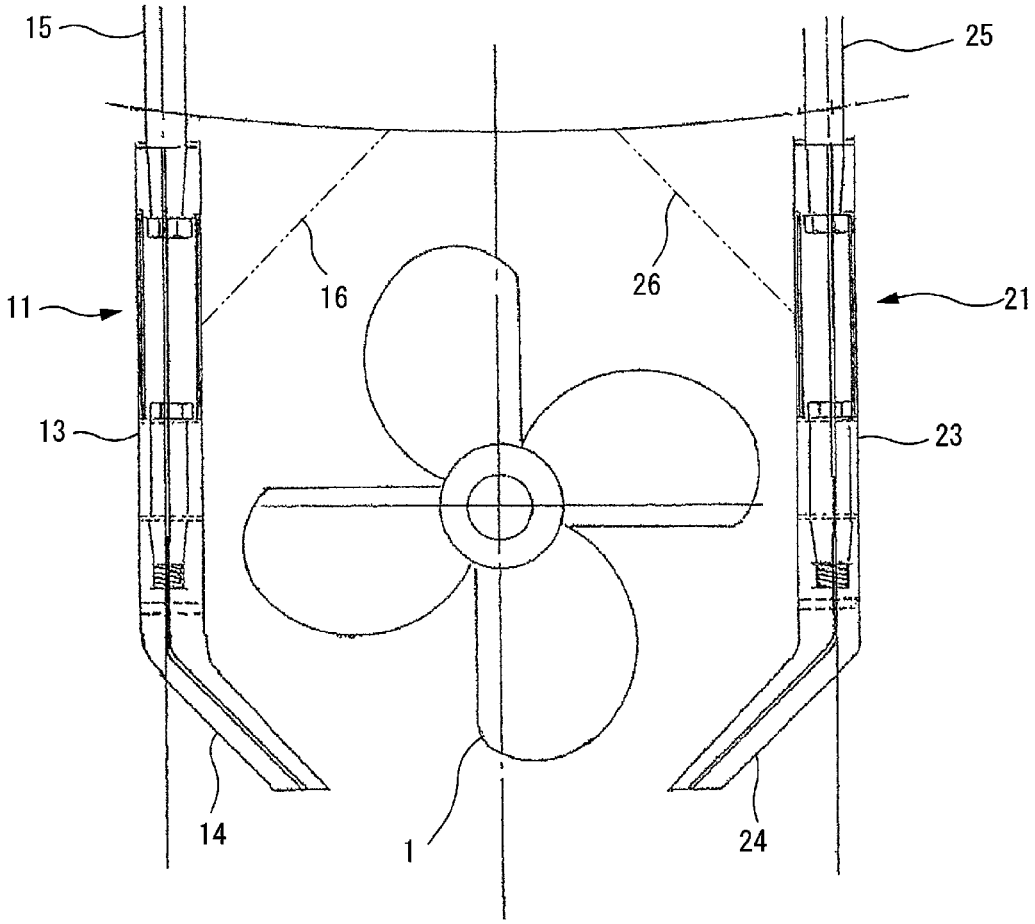

[FIG.3]
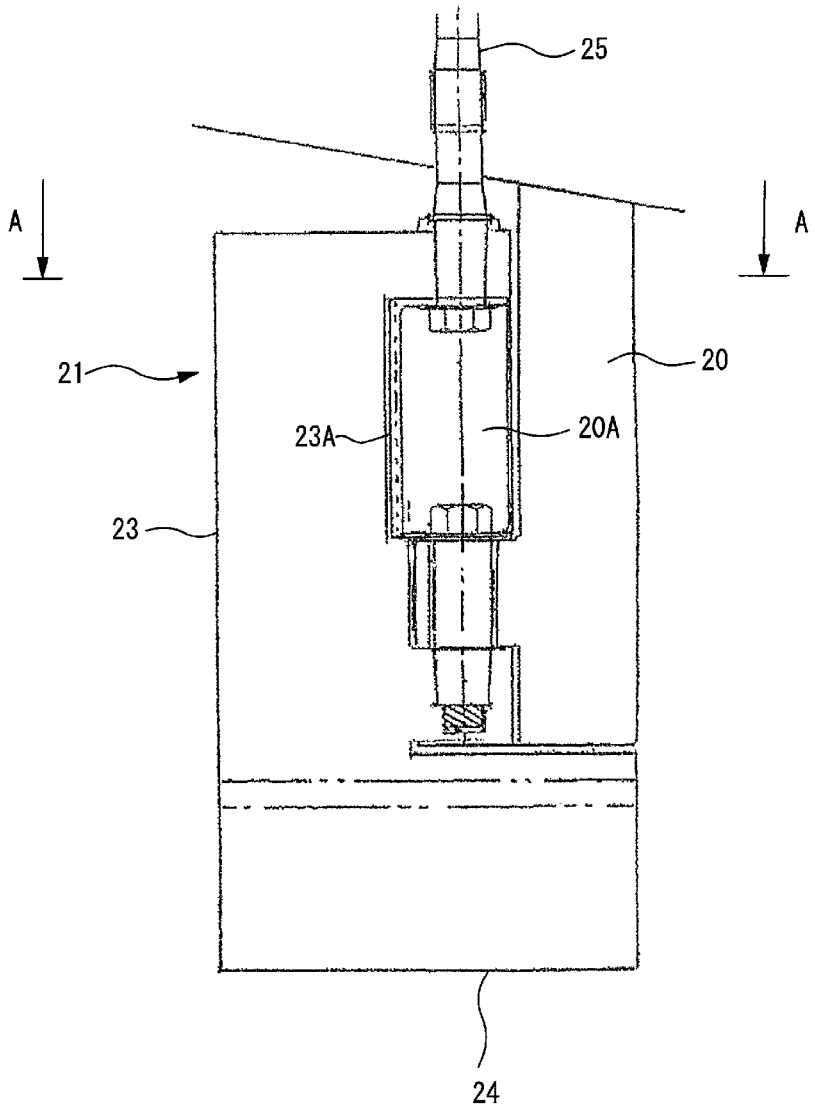

[FIG.4]
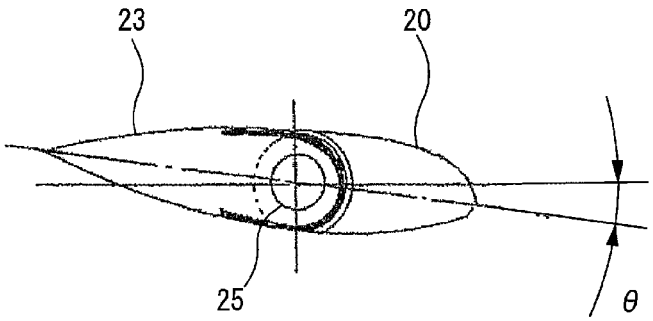
[FIG.5]
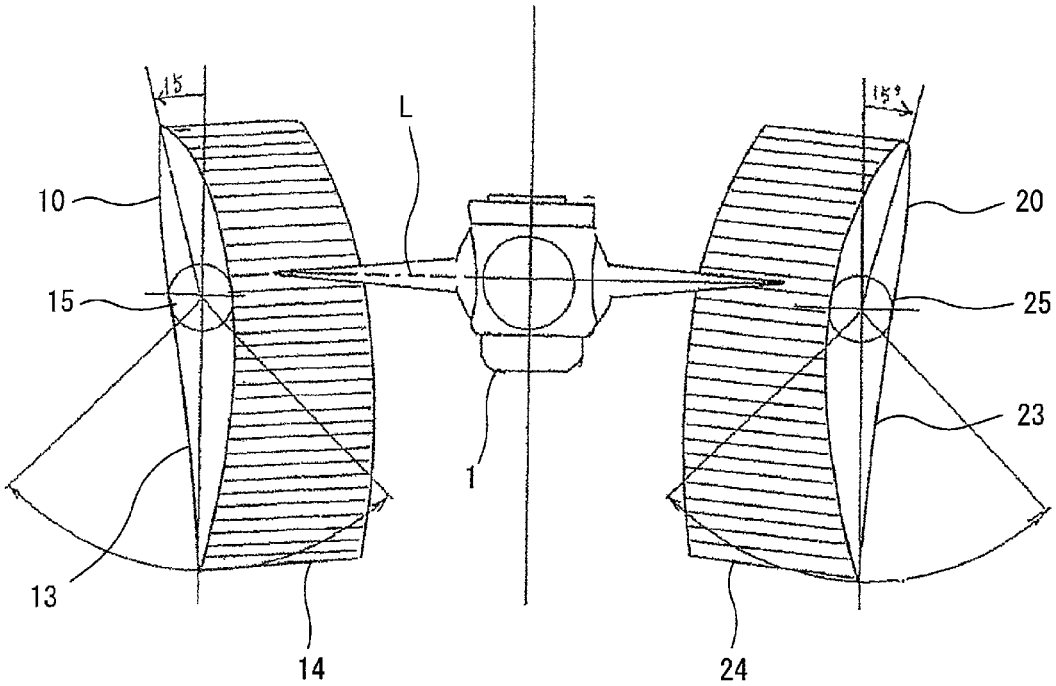

[FIG.6]
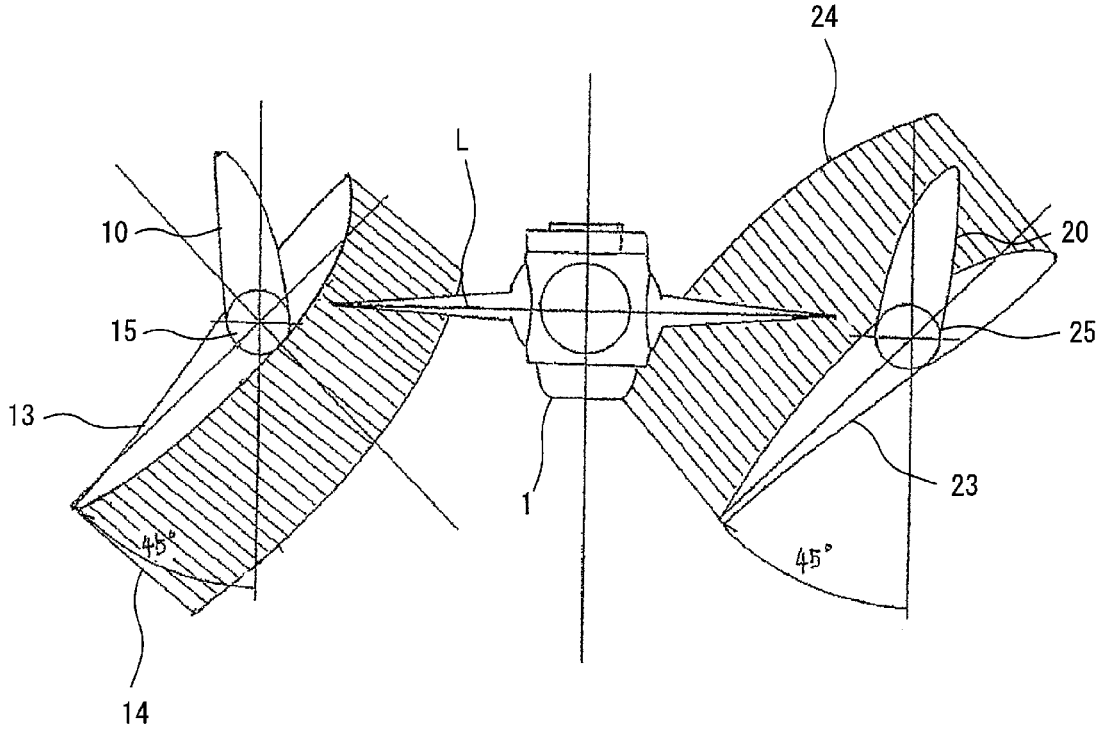

[FIG.7]
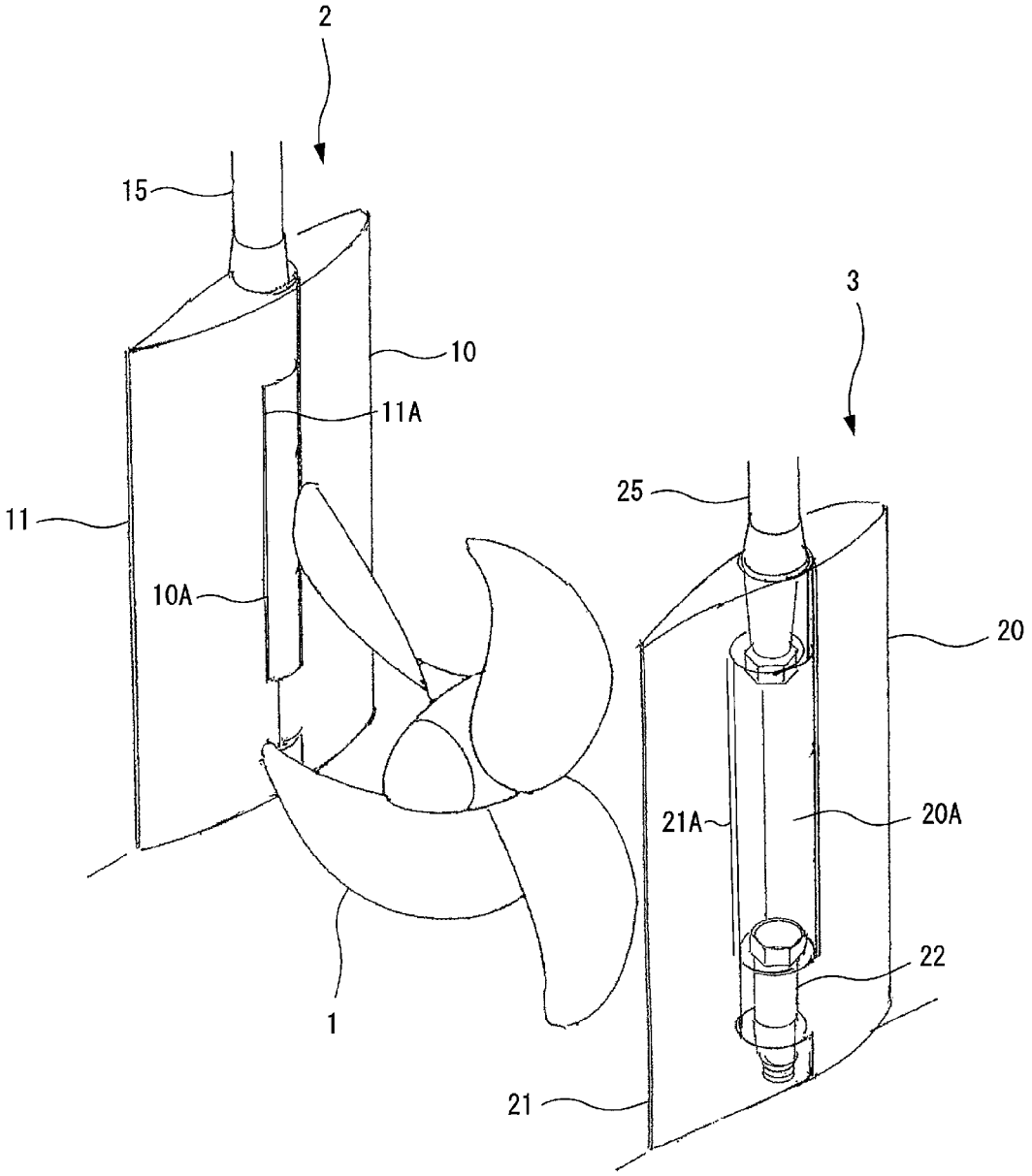

[FIG.8]
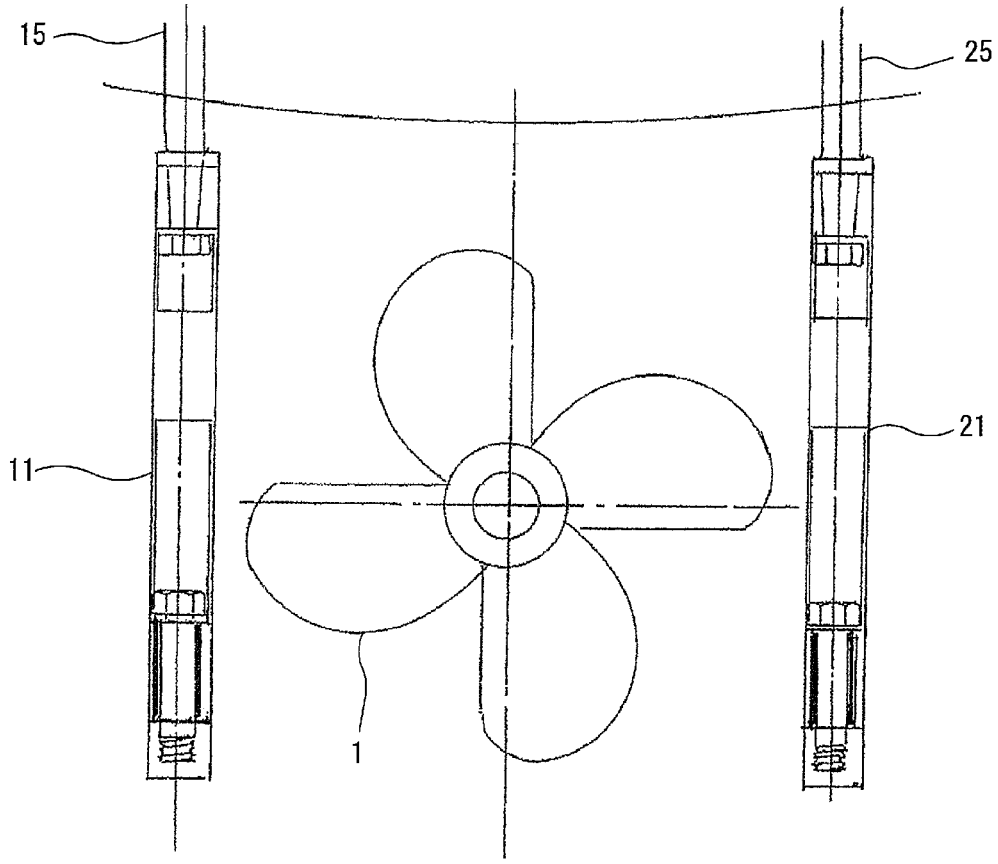

[FIG.9]
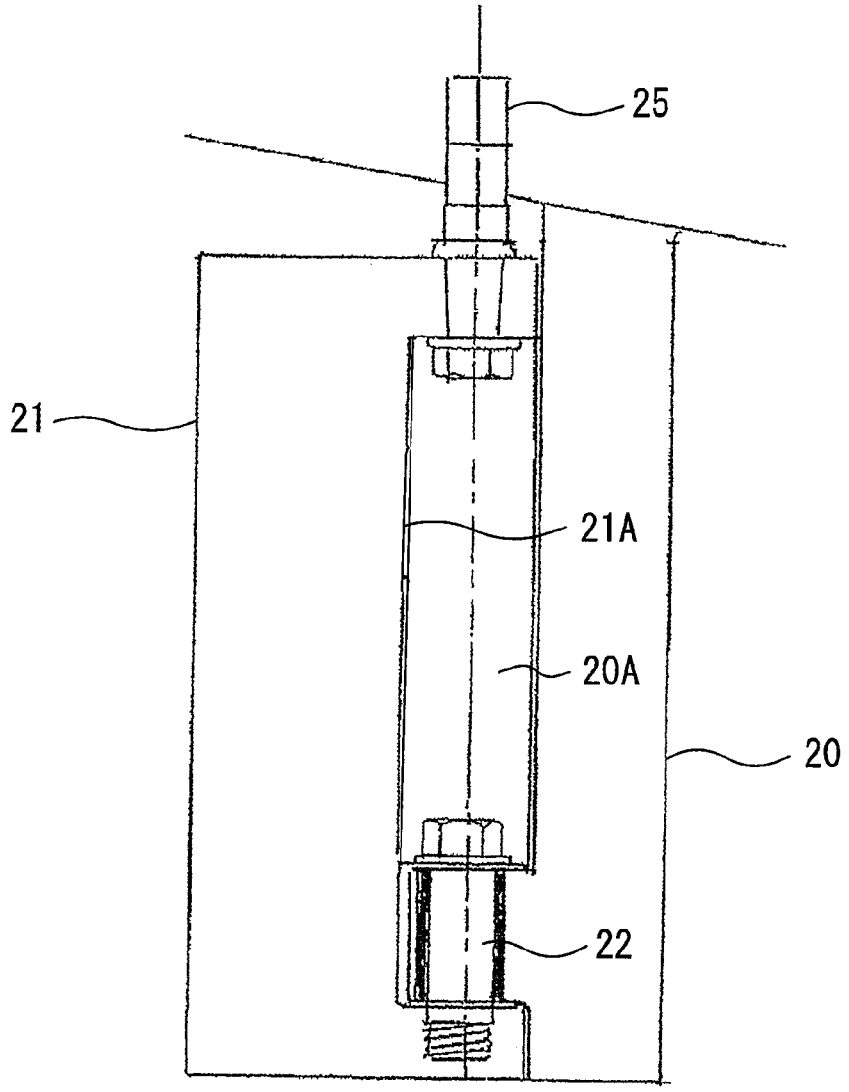

STEERING DEVICE

CROSS-REFERENCE TO RELATED APPLICATIONS

This application is the U.S. national stage application of International Application PCT/JP2020/028436, filed Jul. 22, 2020. The International Application claims priority of Japanese Patent Application No. 2019-213266, filed Nov. 26, 2019. The international application and Japanese application are both incorporated herein by reference, in entirety.

TECHNICAL FIELD

The present invention relates to a steering device of a ship.

BACKGROUND ART

A technique is known in which a port side rudder and a starboard side rudder are provided on both sides of a propeller in order to improve the propulsion performance of a ship. In addition, a technique is known in which the port side rudder and the starboard side rudder are independently turned to improve the turning performance and the stopping performance of a ship (e.g., refer to Patent Literature 1).

CITATION LIST

Patent Literature

Patent Literature 1: JP 2014-73815 A

SUMMARY OF INVENTION

Technical Problem

However, according to the means of Patent Literature 1, if the left rudder plate of the port side rudder and the right rudder plate of the starboard side rudder become large, there is a risk that the left rudder plate and the right rudder plate may become resistant and the ship may not be able to travel efficiently. In addition, there is a risk that the shaft diameters of the left steering shaft that suspends the left rudder plate and the right steering shaft that suspends the right rudder plate would become excessively large.

Therefore, an object of the present invention is to provide a steering device capable of suppressing the resistance of a left rudder plate and a right rudder plate and allowing a ship to travel efficiently.

Solution to Problem

The present invention that solves the problems described above is as follows.

The invention recited in claim 1 is a steering device including a port side rudder plate arranged on a port side of a propeller of a ship and a starboard side rudder plate arranged on a starboard side of the propeller, in which the port side rudder plate is formed of a left front rudder plate fixed to a lower portion of a stern and extending in a vertical direction and a left rear rudder plate provided behind the left front rudder plate and extending in the vertical direction, the starboard side rudder plate is formed of a right front rudder plate fixed to the lower portion of the stern and extending in the vertical direction and a right rear rudder plate provided behind the right front rudder plate and extending in the vertical direction, the left rear rudder plate is turnably supported by a rear portion of the left front rudder plate and a left steering shaft fixed to the left rear rudder plate and extending in the vertical direction, the right rear rudder plate is turnably supported by a rear portion of the right front rudder plate and a right steering shaft fixed to the right rear rudder plate and extending in the vertical direction, and, in a rear view, lower end portions of the port side rudder plate and the starboard side rudder plate are located at a lower end portion of a rotation outer peripheral portion of the propeller.

The invention recited in claim 2 is the steering device according to claim 1, in which the left rear rudder plate is formed of a left vertical portion provided behind the left front rudder plate and a left inclined portion extending downward right from a lower portion of the left vertical portion, the right rear rudder plate is formed of a right vertical portion provided behind the right front rudder plate and a right inclined portion extending downward left from a lower portion of the right vertical portion, the left inclined portion extends from a front portion of the left front rudder plate to a rear portion of the left vertical portion and the right inclined portion extends from a front portion of the right front rudder plate to a rear portion of the right vertical portion in a side view, and lower end portions of the left inclined portion and the right inclined portion are located at a lower end portion of the rotation outer peripheral portion of the propeller in the rear view.

The invention recited in claim 3 is the steering device according to claim 2, in which a right surface of the left front rudder plate and the lower portion of the stern are connected by a left connecting member, a left surface of the right front rudder plate and the lower portion of the stern are connected by a right connecting member, and the left connecting member is provided parallel to the right inclined portion and the right connecting member is provided parallel to the left inclined portion in the rear view.

The invention recited in claim 4 is the steering device according to any one of claims 1 to 3, in which the left steering shaft and the right steering shaft are provided close to behind a center line in a front-rear direction of the propeller in a plan view.

The invention recited in claim 5 is the steering device according to any one of claims 1 to 4, in which, in the plan view, a front portion of the port side rudder plate is provided leftward than a rear portion of the port side rudder plate, and a front portion of the starboard side rudder plate is provided rightward than a rear portion of the starboard side rudder plate.

The invention recited in claim 6 is the steering device according to any one of claims 1 to 5, in which, when a steering handle of a bridge is operated from a straight-ahead state to a full port-turning state, the left steering shaft and the right steering shaft rotate clockwise by 30 to 60 degrees in the plan view, and when the steering handle of the bridge is operated from the straight-ahead state to a full starboard-turning state, the left steering shaft and the right steering shaft rotate counterclockwise by 30 to 60 degrees in the plan view.

Advantageous Effects of Invention

According to the invention recited in claim 1, the port side rudder plate is formed of a left front rudder plate fixed to a lower portion of a stern and extending in a vertical direction and a left rear rudder plate provided behind the left front rudder plate and extending in the vertical direction, the starboard side rudder plate is formed of a right front rudder plate fixed to the lower portion of the stern and extending in the vertical direction and a right rear rudder plate provided behind the right front rudder plate and extending in the vertical direction, the left rear rudder plate is turnably supported by a rear portion of the left front rudder plate and a left steering shaft fixed to the left rear rudder plate and extending in the vertical direction, the right rear rudder plate is turnably supported by a rear portion of the right front rudder plate and a right steering shaft fixed to the right rear rudder plate and extending in the vertical direction, and, in a rear view, lower end portions of the port side rudder plate and the starboard side rudder plate are located at a lower end portion of a rotation outer peripheral portion of the propeller, so that it is possible to suppress the resistance of the port side rudder plate and the starboard side rudder plate during the navigation of the ship and allow the ship to travel efficiently. In addition, it is possible to improve the turning performance of the ship to shorten the advance and turning circle of the ship.

According to the invention recited in claim 2, in addition to the effect of the invention recited in claim 1, the left rear rudder plate is formed of a left vertical portion provided behind the left front rudder plate and a left inclined portion extending downward right from a lower portion of the left vertical portion, the right rear rudder plate is formed of a right vertical portion provided behind the right front rudder plate and a right inclined portion extending downward left from a lower portion of the right vertical portion, the left inclined portion extends from a front portion of the left front rudder plate to a rear portion of the left vertical portion and the right inclined portion extends from a front portion of the right front rudder plate to a rear portion of the right vertical portion in a side view, and lower end portions of the left inclined portion and the right inclined portion are located at a lower end portion of the rotation outer peripheral portion of the propeller in the rear view, so that it is possible to increase the flow velocity of the water flow flowing into the propeller from the front of the propeller to improve the efficiency of the propeller. In addition, it is possible to recover the energy of the high-speed rotating flow flowing out of the propeller efficiently to suppress the energy loss of the rotating flow.

According to the invention recited in claim 3, in addition to the effect of the invention recited in claim 2, a right surface of the left front rudder plate and the lower portion of the stern are connected by a left connecting member, a left surface of the right front rudder plate and the lower portion of the stern are connected by a right connecting member, and the left connecting member is provided parallel to the right inclined portion and the right connecting member is provided parallel to the left inclined portion in the rear view, so that it is possible to increase the flow velocity of the water flow flowing into the propeller from the front of the propeller further to increase the efficiency of the propeller further.

According to the invention recited in claim 4, in addition to the effect of the invention recited in any one of claims 1 to 3, the left steering shaft and the right steering shaft are provided close to behind a center line in a front-rear direction of the propeller in a plan view, so that it is possible to prevent the left rear rudder plate and the right rear rudder plate, which are turned via the left steering shaft and the right steering shaft, from interfering with the propeller. In addition, it is possible to flow the high-speed water flow that flows into the propeller and the high-speed rotating flow that flows out of the propeller along the port side rudder plate and starboard side rudder plate to generate lift on the port side rudder plate and starboard side rudder plate.

According to the invention recited in claim 5, in addition to the effect of the invention recited in any one of claims 1 to 4, in the plan view, a front portion of the port side rudder plate is provided leftward than a rear portion of the port side rudder plate, and a front portion of the starboard side rudder plate is provided rightward than a rear portion of the starboard side rudder plate, so that it is possible to use the lift generated on the port side rudder plate and starboard side rudder plate efficiently as a thrust of the ship. In addition, it is possible to suppress corrosion due to cavitation that occurs in the front portion of the left rear rudder plate that is turned via the left steering shaft and the front portion of the right rear rudder plate that is turned via the right steering shaft.

According to the invention recited in claim 6, in addition to the effect of the invention recited in any one of claims 1 to 5, when a steering handle of a bridge is operated from a straight-ahead state to a full port-turning state, the left steering shaft and the right steering shaft rotate clockwise by 30 to 60 degrees in the plan view, and when the steering handle of the bridge is operated from the straight-ahead state to a full starboard-turning state, the left steering shaft and the right steering shaft rotate counterclockwise by 30 to 60 degrees in the plan view, so that it is possible to improve the turning performance of the ship to shorten the advance and turning circle of the ship.

BRIEF DESCRIPTION OF DRAWINGS

FIG. 1 is a perspective view of a steering device of the first embodiment as viewed from the rear right side.

FIG. 2 is a rear view of the steering device.

FIG. 3 is a vertical cross-sectional view of the steering device in the front-rear direction.

FIG. 4 is a cross-sectional view taken along line A-A of FIG. 3.

FIG. 5 is a plan view of the steering device when traveling straight.

FIG. 6 is a plan view of the steering device when turning left.

FIG. 7 is a perspective view of the steering device of the first embodiment as viewed from the rear right side.

FIG. 8 is a rear view of the steering device.

FIG. 9 is a vertical cross-sectional view of the steering device in the front-rear direction.

DESCRIPTION OF EMBODIMENTS

<Steering Device of the First Embodiment>

As illustrated in FIGS. 1 to 3, a steering device of the first embodiment includes a port side rudder plate 2 arranged on the left side of a propeller 1 and a starboard side rudder plate 3 arranged on the right side of the propeller 1.

The port side rudder plate 2 is formed of a left front rudder plate 10 located at the front portion and a left rear rudder plate 11 provided behind the left front rudder plate 10. In addition, the starboard side rudder plate 3 is formed of a right front rudder plate 20 located at the front portion and a right rear rudder plate 21 provided behind the right front rudder plate 20.

The left front rudder plate 10 is formed so as to extend in the vertical direction, and the upper portion is fixed to the lower portion of the stern. In addition, a rectangular left convex portion 10A protruding toward the left rear rudder plate 11 than the rear upper portion is formed at the rear lower portion of the left front rudder plate 10, and a left support shaft 12 extending in the vertical direction is provided at the lower portion of the left convex portion 10A.

The left rear rudder plate 11 is formed of a left vertical portion 13 extending in the vertical direction and a left inclined portion 14 formed so as to incline downward to the right from the lower end portion of the left vertical portion 13 in the rear view. In addition, in the side view, the front portion of the left inclined portion 14 formed in a substantially rectangular shape is located at the front portion of the left front rudder plate 10, and the rear portion is located at the rear portion of the left vertical portion 13.

A left steering shaft 15 extending in the vertical direction is provided at the upper portion of the left vertical portion 13, and a rectangular left concave portion 13A into which the left convex portion 10A is inserted is formed at the front lower portion of the left vertical portion 13.

The upper portion of the left steering shaft 15 extends to the inside of a steering machine room, and a steering machine (not illustrated in the drawings) for rotating the left steering shaft 15 is connected to the upper portion of the left steering shaft 15. In addition, the lower portion of the left steering shaft 15 is rotatably fixed to the upper portion of the left convex portion 10A. Note that, as the steering machine, it is possible to use either a rotary vane type steering machine or a Rapson sliding steering machine.

The left vertical portion 13 is turnably supported by the left convex portion 10A via the left support shaft 12 and the left steering shaft 15, and in the axial view of the left steering shaft 15, the left support shaft 12 and the left steering shaft 15 are coaxially provided. As a result, the load of the left rear rudder plate 11 is dispersedly supported by the left front rudder plate 10 and the left steering shaft 15, so that it is possible to prevent the shaft diameter of the left steering shaft 15 from becoming excessively large.

The right front rudder plate 20 is formed so as to extend in the vertical direction, and the upper portion is fixed to the lower portion of the stern. In addition, a rectangular right convex portion 20A protruding toward the right rear rudder plate 21 than the rear upper portion is formed at the rear lower portion of the right front rudder plate 20, and a right support shaft 22 extending in the vertical direction is provided at the lower portion of the right convex portion 20A.

The right rear rudder plate 21 is formed of a right vertical portion 23 extending in the vertical direction and a right inclined portion 24 formed so as to incline downward to the left from the lower end portion of the right vertical portion 23 in the rear view. In addition, in the side view, the front portion of the right inclined portion 24 formed in a substantially rectangular shape is located at the front portion of the right front rudder plate 20, and the rear portion is located at the rear portion of the right vertical portion 23.

A right steering shaft 25 extending in the vertical direction is provided at the upper portion of the right vertical portion 23, and a rectangular right concave portion 23A into which the right convex portion 20A is inserted is formed at the front lower portion of the right vertical portion 23.

The upper portion of the right steering shaft 25 extends to the inside of a steering machine room, and a steering machine (not illustrated in the drawings) for rotating the right steering shaft 25 is connected to the upper portion of the right steering shaft 25. In addition, the lower portion of the right steering shaft 25 is rotatably fixed to the upper portion of the right convex portion 20A. Note that, as the steering machine, it is possible to use either a rotary vane type steering machine or a Rapson sliding steering machine.

The right vertical portion 23 is turnably supported by the right convex portion 20A via the right support shaft 22 and the right steering shaft 25, and in the axial view of the right steering shaft 25, the right support shaft 22 and the right steering shaft 25 are coaxially provided. As a result, the load of the right rear rudder plate 21 is dispersedly supported by the right front rudder plate 20 and the right steering shaft 25, so that it is possible to prevent the shaft diameter of the right steering shaft 25 from becoming excessively large.

In the rear view, the left front rudder plate 10 and the left vertical portion 13 of the left rear rudder plate 11 is provided leftward than the left end portion of the rotation outer peripheral portion of the propeller 1 at a predetermined interval, and the right front rudder plate 20 and the right vertical portion 23 of the right rear rudder plate 21 is provided rightward than the right end portion of the rotation outer peripheral portion of the propeller 1 at a predetermined interval. As a result, it is possible to suppress corrosion due to cavitation on the right surfaces of the left vertical portion 13 of the left front rudder plate 10 and the left rear rudder plate 11 and the left surfaces of the right vertical portion 23 of the right front rudder plate 20 and the right rear rudder plate 21.

In the rear view, it is preferable to locate the lower end portion of the left vertical portion 13 of the left rear rudder plate 11 and the lower end portion of the right vertical portion 23 of the right rear rudder plate 21 approximately at the center in the vertical direction between the center of the propeller 1 and the lower end portion of the rotation outer peripheral portion of the propeller 1 and locate the lower end portion of the left inclined portion 14 of the left rear rudder plate 11 and the lower end portion of the right inclined portion 24 of the right rear rudder plate 21 at the lower end portion of the rotation outer peripheral portion of the propeller 1.

In the case of an inland vessel, as illustrated in FIG. 2, it is preferable to locate the lower end portion of the left inclined portion 14 of the left rear rudder plate 11 and the lower end portion of the right inclined portion 24 of the right rear rudder plate 21 below the lower end portion of the rotation outer peripheral portion of the propeller 1. As a result, it is possible to improve the turning performance of the ship to shorten the advance and turning circle of the ship. On the other hand, in the case of an ocean-going vessel, it is preferable to locate the lower end portion of the left inclined portion 14 of the left rear rudder plate 11 and the lower end portion of the right inclined portion 24 of the right rear rudder plate 21 above the lower end portion of the rotation outer peripheral portion of the propeller 1. As a result, it is possible to suppress the resistance of the left rear rudder plate 11 and the right rear rudder plate 21 to allow the ship to travel efficiently.

In the rear view, it is preferable that the left front rudder plate 10 is provided with a left connecting member 16 that connects the upper portion of the left front rudder plate 10 and the lower portion of the stern and the right front rudder plate 20 is provided with a right connecting member 26 that connects the upper portion of the right front rudder plate 20 and the lower portion of the stern. The left connecting member 16 is formed parallel to the right inclined portion 24 and is provided at a position symmetrical to the right inclined portion 24 with the propeller 1 as a symmetrical center, and the right connecting member 26 is formed parallel to the left inclined portion 14 and is provided at a position symmetrical to the left inclined portion 14 with the propeller 1 as a symmetrical center. As a result, it is possible to increase the flow velocity of the water flow flowing into the propeller 1 from the front of the propeller 1 and improve the efficiency of the propeller 1.

As illustrated in FIG. 4, when the ship travels straight, it is preferable that the left and right surfaces of the port side rudder plate 2, that is, the left and right surfaces formed by the left front rudder plate 10 and the left vertical portion 13 of the left rear rudder plate 11 substantially continuous with the left front rudder plate 10 are formed in a streamlined shape and the left and right surfaces of the starboard side rudder plate 3, that is, the left and right surfaces formed by the right front rudder plate 20 and the right vertical portion 23 of the right rear rudder plate 21 substantially continuous with the right front rudder plate 20 are formed in a streamlined shape. As a result, when the ship travels straight, it is possible to suppress the resistance of the port side rudder plate 2 and the starboard side rudder plate 3 further to allow the ship to travel efficiently.

In addition, as illustrated in FIG. 5, it is also possible to form the left surface of the port side rudder plate 2 into a substantially straight-line shape and the right surface into a protruding shape toward the propeller 1 and form the right surface of the starboard side rudder plate 3 into a substantially straight-line shape and the left surface into a protruding shape toward the propeller 1. As a result, it is possible to prevent the separation of the water flow generated at the rear portion of the port side rudder plate 2 and the starboard side rudder plate 3 and generate lift on the port side rudder plate 2 and the starboard side rudder plate 3.

As illustrated in FIG. 4, in the port side rudder plate 2, the front portion of the port side rudder plate 2 is located leftward than the rear portion to set a predetermined attack angle θ in the counterclockwise direction with respect to the virtual line in the front-rear direction. In the starboard side rudder plate 3, the front portion of the starboard side rudder plate 3 is located rightward than the rear portion to set a predetermined attack angle θ in the clockwise direction with respect to the virtual line in the front-rear direction. As a result, due to the rotating flow flowing out from the propeller 1, lift is generated on the port side rudder plate 2 toward the front left side, and lift is generated on the starboard side rudder 2 toward the front right side. Due to the components in the front-rear direction of the lift, it is possible to generate thrust for navigating the ship forward and recover the energy of the rotating flow by the port side rudder plate 2 and the starboard side rudder plate 3 to convert it into kinetic energy efficiently.

In addition, as illustrated in FIG. 5, the left front rudder plate 10 of the port side rudder plate 2 and the portion of the left inclined portion 14 of the left rear rudder plate 11 located below the left front rudder plate 10 may be provided with a predetermined attack angle θ in the counterclockwise direction with respect to the virtual line in the front-rear direction, the left vertical portion 13 of the left rear rudder plate 11 and the portion of the left inclined portion 14 located below the left front rudder plate 10 may be provided along the virtual line in the front-rear direction, the right front rudder plate 20 of the starboard side rudder plate 3 and the portion of the right inclined portion 24 of the right rear rudder plate 21 located below the right front rudder plate 20 may be provided with a predetermined attack angle θ in the clockwise direction with respect to the virtual line in the front-rear direction, and the right vertical portion 23 of the right rear rudder plate 21 and the portion of the right inclined portion 24 located below the right front rudder plate 20 may be provided along the virtual line in the front-rear direction. As a result, in the plan view, it is possible to prevent corrosion on the front portion of the left inclined portion 14 caused by cavitation when the left steering shaft 15 is rotated clockwise to bring the front portion of the left inclined portion 14 closer to the propeller 1 and prevent corrosion on the front portion of the right inclined portion 24 caused by cavitation when the right steering shaft 25 is rotated counterclockwise to bring the front portion of the right inclined portion 24 closer to the propeller 1. Note that FIG. 5 illustrates a form in which the attack angle θ is set to 15 degrees.

As illustrated in FIG. 5, the left steering shaft 15 is provided at a 30 to 35% position of the length of the port side rudder plate 2 in the front-rear direction from the front end portion of the port side rudder plate 2. In addition, the right steering shaft 25 is provided at a 30 to 35% position of the length of the starboard side rudder plate 3 in the front-rear direction from the front end portion of the starboard side rudder plate 3. As a result, it is possible to make the rotating steering machine of the left steering shaft 15 smaller since the left steering shaft 15 and the centers of the loads applied to the port side rudder plate 2 are close to each other, and it is possible to make the rotating steering machine of the starboard shaft 25 smaller since the right steering shaft 25 and the centers of the loads applied to the starboard side rudder plate 3 are close to each other.

In the front-rear direction, the left steering shaft 15 is provided adjacent behind the center line L in the front-rear direction of the propeller 1, and the front portion of the left steering shaft 15 is provided extending forward beyond the center line L in the front-rear direction of the propeller 1. In addition, the right steering shaft 25 is provided adjacent behind the center line L in the front-rear direction of the propeller 1, and the front portion of the right steering shaft 25 is provided extending forward beyond the center line L in the front-rear direction of the propeller 1. As a result, it is possible to prevent interference between the left rear rudder plate 11 turned by the left steering shaft 15 and the propeller 1 and prevent interference between the right rear rudder plate 21 turned by the right steering shaft 25 and the propeller 1. In addition, it is possible to flow the high-speed water flow that flows into the propeller 1 and the high-speed rotating flow that flows out of the propeller 1 along the port side rudder plate 2 and starboard side rudder plate 3 to generate large lift on the port side rudder plate 2 and starboard side rudder plate 3.

As illustrated in FIG. 6, when the steering handle (not illustrated in the drawings) of the bridge is operated from straight ahead to port turning, the left steering shaft and the right steering shaft 25 are rotated clockwise by a predetermined angle, for example, 45 degrees, and the left rear rudder plate 11 turns by 45 degrees clockwise centering around the left steering shaft 15, and the right rear rudder plate 21 turns by 45 degrees clockwise centering around the right steering shaft 25. On the other hand, when the steering handle is operated from straight ahead to starboard turning, the left steering shaft 15 and the right steering shaft 25 are rotated counterclockwise by a predetermined angle, for example, 45 degrees, and the left rear rudder plate 11 turns by 45 degrees counterclockwise centering around the left steering shaft 15, and the right rear rudder plate 21 rturns by 45 degrees counterclockwise centering around the right steering shaft 25. Note that it is possible to set the rotating angles of the left steering shaft 15 and the right steering shaft 25 at the time of port turning and the rotating angles of the left steering shaft 15 and the right steering shaft 25 at the time of starboard turning arbitrarily in the range of 30 to 60 degrees via a controller. Note that FIG. 6 illustrates the steering device used for an inland vessel in a form that the rotating angles of the left steering shaft 15 and the right steering shaft 25 are set to 45 degrees.

<Steering Device of the Second Embodiment>

Next, a steering device of the second embodiment will be described. Note that the same members and parts as those of the steering device of the first embodiment are designated by the same signs, and the description thereof will be omitted.

As illustrated in FIGS. 7 to 9, the left front rudder plate 10 is formed so as to extend in the vertical direction, and the upper portion is fixed to the lower portion of the stern. In addition, a rectangular left convex portion 10A protruding toward the left rear rudder plate 11 than the rear upper portion and the rear lower portion is formed in the rear intermediate portion of the left front rudder plate 10.

The left rear rudder plate 11 is formed so as to extend in the vertical direction, and a rectangular left concave portion 11A into which the left convex portion 10A is inserted is formed at the front intermediate portion of the left rear rudder plate 11.

The left rear rudder plate 11 is turnably supported by the left convex portion 10A via the left support shaft 12 and the left steering shaft 15, and in the axial view of the left steering shaft 15, the left support shaft 12 and the left steering shaft 15 are coaxially provided. As a result, the load of the left rear rudder plate 11 is dispersedly supported by the left front rudder plate 10 and the left steering shaft 15, so that it is possible to prevent the shaft diameter of the left steering shaft 15 from becoming excessively large.

The right front rudder plate 20 is formed so as to extend in the vertical direction, and the upper portion is fixed to the lower portion of the stern. In addition, a rectangular left convex portion 20A protruding toward the right rear rudder plate 21 than the rear upper portion and the rear lower portion is formed in the rear intermediate portion of the right front rudder plate 20.

The right rear rudder plate 21 is formed so as to extend in the vertical direction, and a rectangular right concave portion 21A into which the right convex portion 20A is inserted is formed at the front intermediate portion of the right rear rudder plate 21.

The right rear rudder plate 21 is turnably supported by the right convex portion 20A via the right support shaft 22 and the right steering shaft 25, and in the axial view of the right steering shaft 25, the right support shaft 22 and the right steering shaft 25 are coaxially provided. As a result, the load of the right rear rudder plate 21 is dispersedly supported by the right front rudder plate 20 and the right steering shaft 25, so that it is possible to prevent the shaft diameter of the right steering shaft 25 from becoming excessively large.

In the rear view, the left front rudder plate 10 and the left rear rudder plate 11 are provided leftward than the left end portion of the rotation outer peripheral portion of the propeller 1 at a predetermined interval, and the right front rudder plate 20 and the right rear rudder plate 21 are provided rightward than the right end portion of the rotation outer peripheral portion of the propeller 1 at a predetermined interval. As a result, it is possible to suppress corrosion due to cavitation on the right surfaces of the left front rudder plate 10 and the left rear rudder plate 11 and the left surfaces of the right front rudder plate 20 and the right rear rudder plate 21.

In the rear view, it is preferable to locate the lower end portions of the left front rudder plate 10 and the left rear rudder plate 11 and the lower end portions of the right front rudder plate 20 and the right rear rudder plate 21 at the lower end portion of the rotation outer peripheral portion of the propeller 1.

In the case of an inland vessel, as illustrated in FIG. 8, it is preferable to locate the lower end portions of the left front rudder plate 10 and the left rear rudder plate 11 and the lower end portions of the right front rudder plate 20 and the right rear rudder plate 21 below the lower end portion of the rotation outer peripheral portion of the propeller 1. As a result, it is possible to improve the turning performance of the ship to shorten the advance and turning circle of the ship. On the other hand, in the case of an ocean-going vessel, it is preferable to locate the lower end portions of the left front rudder plate 10 and the left rear rudder plate 11 and the lower end portions of the right front rudder plate 20 and the right rear rudder plate 21 above the lower end portion of the rotation outer peripheral portion of the propeller 1. As a result, it is possible to suppress the resistance of the left rear rudder plate 11 and the right rear rudder plate 21 to allow the ship to travel efficiently.

INDUSTRIAL APPLICABILITY

The present invention can be applied to a steering device of a ship.

REFERENCE SIGNS LIST

1 Propeller
2 Port side rudder plate
3 Starboard side rudder plate
10 Left front rudder plate
11 Left rear rudder plate
13 Left vertical portion
14 Left inclined portion
15 Left steering shaft
16 Left connecting member
20 Right front rudder plate
21 Right rear rudder plate
23 Right vertical portion
24 Right inclined portion
25 Right steering shaft
26 Right connecting member
L Center line

The invention claimed is:

1. A steering device comprising:

a port side rudder plate arranged on a port side of a propeller of a ship; and a starboard side rudder plate arranged on a starboard side of the propeller, wherein the port side rudder plate is formed of a left front rudder plate fixed to a lower portion of a stern and extending in a vertical direction and a left rear rudder plate provided behind the left front rudder plate and extending in the vertical direction, the starboard side rudder plate is formed of a right front rudder plate fixed to the lower portion of the stern and extending in the vertical direction and a right rear rudder plate provided behind the right front rudder plate and extending in the vertical direction, the left rear rudder plate is turnably supported by a rear portion of the left front rudder plate and a left steering shaft fixed to the left rear rudder plate and extending in the vertical direction, the right rear rudder plate is turnably supported by a rear portion of the right front rudder plate and a right steering shaft fixed to the right rear rudder plate and extending in the vertical direction, the left rear rudder plate is formed of a left vertical portion provided behind the left front rudder plate and a left inclined portion extending downward right from a lower portion of the left vertical portion, the right rear rudder plate is formed of a right vertical portion provided behind the right front rudder plate and a right inclined portion extending downward left from a lower portion of the right vertical portion, in a side view, the left inclined portion extends from a front portion of the left front rudder plate to a rear portion of the left vertical portion and the right inclined portion extends from a front portion of the right front rudder plate to a rear portion of the right vertical portion, and in the rear view, lower end portions of the left inclined portion and the right inclined portion are located at a lower end portion of the rotation outer peripheral portion of the propeller.

2. The steering device according to claim 1, wherein a right surface of the left front rudder plate and the lower portion of the stern are connected by a left connecting member, a left surface of the right front rudder plate and the lower portion of the stern are connected by a right connecting member, and in the rear view, the left connecting member is provided parallel to the right inclined portion and the right connecting member is provided parallel to the left inclined portion.

3. The steering device according to claim 1, wherein the left steering shaft and the right steering shaft are provided close to behind a center line in a front-rear direction of the propeller in a plan view.

4. The steering device according to claim 1, wherein, in the plan view, a front portion of the port side rudder plate is provided leftward than a rear portion of the port side rudder plate, and a front portion of the starboard side rudder plate is provided rightward than a rear portion of the starboard side rudder plate.

5. The steering device according to claim 1, wherein, when a steering handle of a bridge is operated from a straight-ahead state to a full port-turning state, the left steering shaft and the right steering shaft rotate clockwise by 30 to 60 degrees in the plan view, and when the steering handle of the bridge is operated from the straight-ahead state to a full starboard-turning state, the left steering shaft and the right steering shaft rotate counterclockwise by 30 to 60 degrees in the plan view.

6. The steering device according to claim 2, wherein the left steering shaft and the right steering shaft are provided close to behind a center line in a front-rear direction of the propeller in a plan view.

7. The steering device according to claim 2, wherein, in the plan view, a front portion of the port side rudder plate is provided leftward than a rear portion of the port side rudder plate, and a front portion of the starboard side rudder plate is provided rightward than a rear portion of the starboard side rudder plate.

8. The steering device according to claim 3, wherein, in the plan view, a front portion of the port side rudder plate is provided leftward than a rear portion of the port side rudder plate, and a front portion of the starboard side rudder plate is provided rightward than a rear portion of the starboard side rudder plate.

9. The steering device according to claim 2, wherein, when a steering handle of a bridge is operated from a straight-ahead state to a full port-turning state, the left steering shaft and the right steering shaft rotate clockwise by 30 to 60 degrees in the plan view, and when the steering handle of the bridge is operated from the straight-ahead state to a full starboard-turning state, the left steering shaft and the right steering shaft rotate counterclockwise by 30 to 60 degrees in the plan view.

10. The steering device according to claim 3, wherein, when a steering handle of a bridge is operated from a straight-ahead state to a full port-turning state, the left steering shaft and the right steering shaft rotate clockwise by 30 to 60 degrees in the plan view, and when the steering handle of the bridge is operated from the straight-ahead state to a full starboard-turning state, the left steering shaft and the right steering shaft rotate counterclockwise by 30 to 60 degrees in the plan view.

11. The steering device according to claim 4, wherein, when a steering handle of a bridge is operated from a straight-ahead state to a full port-turning state, the left steering shaft and the right steering shaft rotate clockwise by 30 to 60 degrees in the plan view, and when the steering handle of the bridge is operated from the straight-ahead state to a full starboard-turning state, the left steering shaft and the right steering shaft rotate counterclockwise by 30 to 60 degrees in the plan view.

* * * * *